United States Patent [19]

Norwell

[11] Patent Number: 4,464,072

[45] Date of Patent: Aug. 7, 1984

[54] CLEANING DEVICE FOR GOLF CLUBS

[76] Inventor: John B. Norwell, Taunton Ridge Rd., Newtown, Conn. 06470

[21] Appl. No.: 370,343

[22] Filed: Apr. 21, 1982

[51] Int. Cl.[3] ..... A46B 11/02

[52] U.S. Cl. ..... 401/137; 15/21 A; 273/32 R; 273/32 B; 401/139

[58] Field of Search ..... 401/137, 139; 222/180; 24/3 F, 3 J, 35, 3 L; 15/21 A; 273/32 R, 32 B; 150/1.5 R

[56] References Cited

U.S. PATENT DOCUMENTS

| | | | |
|---|---|---|---|
| 2,828,500 | 4/1958 | Peacock | 401/137 |
| 2,886,839 | 5/1959 | Leopoldi . | |
| 3,178,070 | 4/1965 | Leland | 222/180 |
| 3,226,760 | 1/1966 | Grote | 401/139 |
| 3,279,009 | 10/1966 | Deane | 24/35 |
| 3,583,016 | 6/1971 | McConnell | 15/21 A |
| 4,210,974 | 7/1980 | Stoltzman | 15/21 A |

FOREIGN PATENT DOCUMENTS

| | | | |
|---|---|---|---|
| 573899 | 4/1959 | Canada | 150/1.5 R |
| 360675 | 4/1962 | Switzerland | 401/183 |

*Primary Examiner*—Steven A. Bratlie

*Attorney, Agent, or Firm*—St. Onge Steward Johnson & Reens

[57] ABSTRACT

A cleaning device (10), particularly adapted for releasable attachment to a golf bag (20), to enable rapid and complete cleaning of golf clubs during play, is disclosed.

The device preferably comprises a liquid container (30) having a liquid spray means (40) positioned therein; a retaining means (50) which includes a sleeve (52) for holding the container, a clip means (54) for attaching to the top of the golf bag, and a support release (56); and a brush means (60). Lobes (32, 32') on the rear of the container engage the upper beaded edge (22) of the wall (24) of the golf bag preventing accidental displacement from the bag. Outwardly projecting portions (58, 58') on the sleeve conform to the rounded exterior of the bag and provide a fulcrum permitting the lobes to be pivoted away from the beaded edge by pressing against lower portion (57) of the support release. By this arrangement, the whole device is securely fastened to the golf bag during normal play and club cleaning, and yet easy removal of the container and the associated brush and spray are permitted when required.

4 Claims, 6 Drawing Figures

Fig. 1.
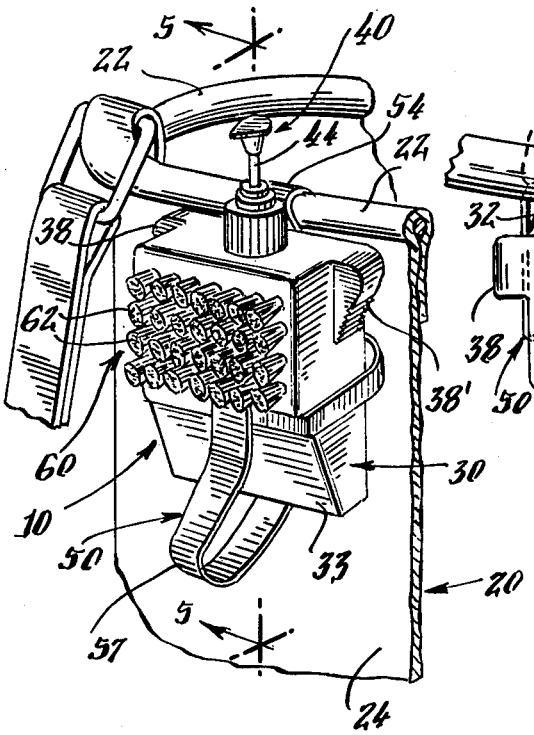
Fig. 2.
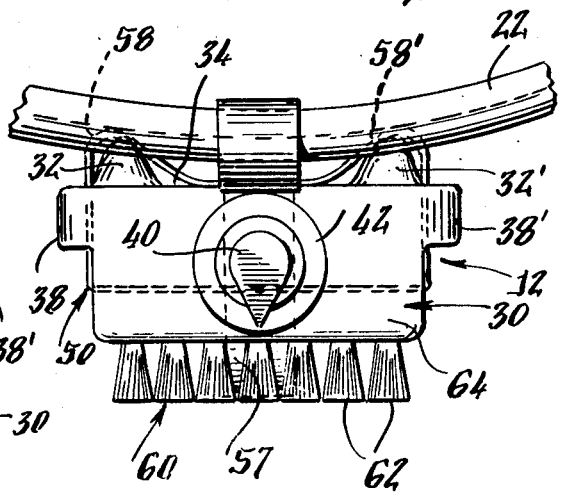
Fig. 3.
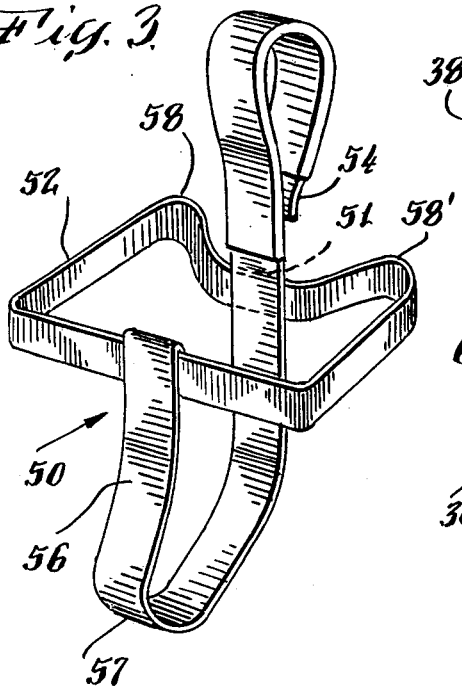
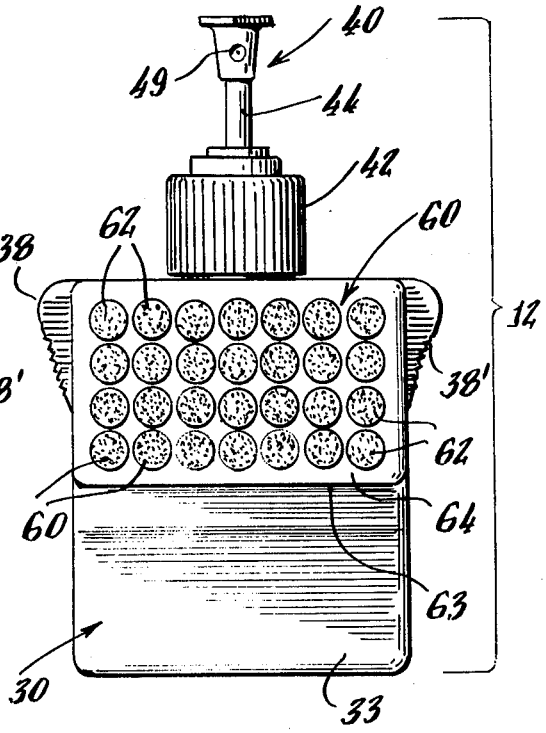
Fig. 4.

CLEANING DEVICE FOR GOLF CLUBS

DESCRIPTION

1. Technical Field

My invention relates to a portable cleaning device, and in its preferred aspects to a device adapted for releasable attachment to a golf bag to enable rapid and complete cleaning of golf clubs during play.

There are a number of applications for which portable cleaning devices would be useful. For example, for cleaning windows, golf clubs, white-wall automobile tires, automobile and aircraft interiors, and other like uses, it is often desirable to have readily available not only a supply of cleaning fluid in a suitable dispenser, but also a scrubbing device such as brush for removing heavy build-ups of dirt or other difficultly removed grime. Often, for cleaning applications such as these, the work of cleaning is only incidental to the principal activity, and it would be advantageous to have a self-contained, highly-portable cleaning device which could be securely fastened for immediate access without getting in the way. This is especially true in the case of cleaning golf clubs during a round of golf.

Golf is a game of precision. Every facet of the game, from equipment design and maintenance to the mechanics of the swing, has been extensively analyzed by professional and amateur players, as well as by more scientifically-oriented professional designers. The club face, for example, is configured with a series of scoring lines and a surface finish to enable the golfer to impart a desired spin to the ball when the ball is properly struck. It is generally recognized that the club face, including the scoring lines, should be kept clean to assure achieving the desired result. A dirty club face may cause a result much different from that desired. And, golfers are somewhat notorious for giving themselves every reasonable benefit.

Unfortunately, it has been difficult in practice, especially without a caddy, to maintain the club faces clean during an entire round of golf. Typically, a golfer will carry a towel to remove loosely-adhered dirt from the club face and will often resort to employing a golf tee, if time permits between shots, to remove encrusted dirt or grass from the club face and the scoring lines. However, despite the usual efforts along these lines, it is typical for the faces of golf clubs to become significantly soiled near the end of a round. This can adversely affect the player's ability to execute a desired shot, but complete club cleaning during a round of golf has not been practical up to the present time.

For a golf club cleaner to be practical it should have a supply of a suitable liquid cleaning and treating composition, it should be capable of being rapidly attached to and removed from a cart or golf bag but yet resist accidental displacement, it should permit easy application of the liquid to the clubs, and it should have a scrubbing attachment capable of removing even the most difficultly encrusted grass and soil from scoring lines as well as smooth surfaces. For greatest utility, the device should be durable enough to withstand the heat of sunlight during exposure for extended periods of time, enable viewing the level of liquid within the container, and permit cleaning while either holding the device by hand or in its position supported on the golf bag or cart.

Such a device could, with proper formulation of the liquid, be employed for cleaning club face grooves, cleaning and polishing the club heads, cleaning golf balls, moistening and softening golf gloves, cleaning and preserving golf shoes, and cleaning and treating the golf bag and other equipment. Also desirably, the device could provide a handy holder for a towel.

2. Background Art

The prior art has provided a number of portable cleaning devices, some of which include scrubbing or scraping means along with a supply of liquid; however, to my knowledge, no one has ever provided a portable cleaning device which contains the combination of a liquid dispensing means, a retaining means for holding the dispenser means and attaching it to a support, and a brush means associated with the liquid dispensing and retaining means. And, without at least these principal features in combination, the desired combination of convenience and effectiveness cannot be attained.

One prior art cleaning device is shown in U.S. Pat. No. 2,886,839 to Leopoldi. That device is specifically adapted for use in window cleaning by the provision of a combination of a fixed squeegee, a removable scraper and a sponge—all mounted in a specific arrangement on a flexible plastic bottle which permits the application of desired cleaning forces without distorting the shape of the container or the squeegee. While the device does appear to be portable from the illustration in the patent, it would not be adaptable for a variety of cleaning applications, such as cleaning golf clubs, because the sponge attachment would not provide the necessary cleaning of scoring lines in the golf club. Additionally, because the spray of liquid is dispensed in a straight line from the top of the container and the container must be squeezed to discharge the spray, it is only adaptable to hand-held use and would not permit use while attached to a support such as a golf bag. Moreover, no suitable retaining means are disclosed for holding the flexible container and attaching it to a support.

There remains a need for a device capable of a variety of cleaning operations including, in particular, the cleaning of golf clubs either while held in the hand or while firmly, releasably attached to a golf bag or golf cart. Accordingly, it is an object of the present invention to provide a device of this type which meets this need and, in its more preferred aspects, provides other desirable attributes and advantages.

DISCLOSURE OF INVENTION

In accordance with the present invention, I provide a cleaning device comprising: liquid dispensing means, retaining means for holding the dispenser means and attaching it to a support, and brush means associated with the liquid dispensing and retaining means. Preferably, the liquid dispensing means and the retaining means are both configured to engage a beaded upper edge of a support wall to prevent accidental displacement. The device will further preferably permit release of the liquid dispensing means from the retaining means for hand-held operation where this is desired.

According to a preferred embodiment, the brush means is fixed to the liquid dispensing means such that the two are integral. However, in other embodiments, the brush means can be affixed to the retaining means.

It is preferable to employ a liquid spray means which directs a spray from the top of the dispensing means in a direction perpendicular to the longitudinal axis of the device; however, it is within the contemplation of the invention to have the spray emanate from the area of the brush means or any other suitable location which will enable operation of the device either when held in the hand or when attached to a suitable support.

Further according to the preferred embodiments of the invention, the retaining means will be configured to provide an integral towel holder in view of the common need for a towel to dry clubs after they have been wetted due to washing, rain, or general wet playing conditions.

BRIEF DESCRIPTION OF THE DRAWINGS

The invention will be better understood and its advantages will become more apparent when the following detailed description is read in light of the accompanying drawings, wherein:

FIG. 1 is a perspective view showing a cleaning device according to the invention in place on the top of the golf bag;

FIG. 2 is a top plan view showing a preferred embodiment of the invention in place on a golf bag;

FIG. 3 is a perspective view of the retaining means of the device shown in FIG. 1;

FIG. 4 is a front elevation of the device shown in FIG. 1;

BEST MODE FOR CARRYING OUT THE INVENTION

Figure 5:
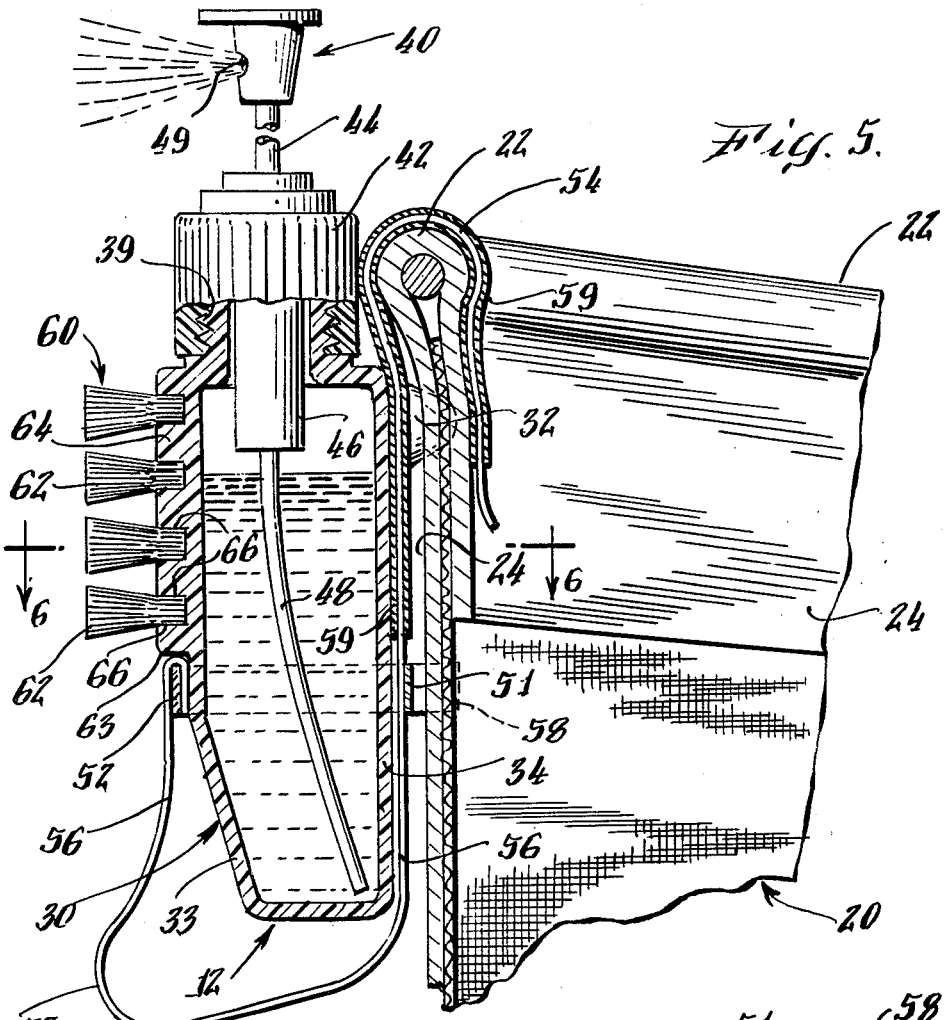
FIG. 5 is a longitudinal cross-section taken along line 5—5 in FIG. 1.

While various applications of the cleaning device of the invention are possible besides its use for cleaning golf clubs, the device in at least its preferred embodiments is particularly adapted to such use. Accordingly, the following description will focus upon this preferred use as exemplary, and the advantages of the invention for this use will be particularly emphasized. It is not intended, however, to imply that the device of the invention is limited only for use in cleaning golf clubs. In fact, even in the field of golf, the device is further useful for cleaning golf balls, moistening and softening golf gloves, cleaning and preserving golf shoes, and cleaning and treating golf bags.

In the perspective view illustrated in FIG. 1, the cleaning device 10 is shown to be releasably attached to a golf bag 20 to enable rapid and complete cleaning of the golf clubs during play. Broadly, the device comprises a liquid dispensing means, shown bracketed as 12 in FIG. 4, retaining means 50 for holding the dispensing means and attaching it to a support, and brush means 60 associated with the liquid dispensing and retaining means.

Referring now to FIGS. 2 and 4 in particular, the liquid dispensing means 12 is shown to have two principal parts, a liquid container 30 and a liquid spray means 40. The container 30 is preferably constructed of a relatively rigid plastic material such as a polycarbonate resin. To enable the container 30 to withstand long periods of exposure to sunlight, it preferably contains an ultra-violet light stabilizer of the type known to the art. The container 30 is preferably translucent such that the level of liquid contained therein is visible without removing the liquid spray means 40. The container is preferably molded in two halves in conventional manner and then ultrasonically welded to provide a high-strength, unitary container. To provide the desired degree of rigidity and structural stability, a polycarbonate resin having a wall thickness of about 0.060 inches is preferred.

The container 30 is of generally rectangular construction having lobes 32 and 32' outwardly projecting from at least two opposed peripheral portions of the rear wall 34. These lobes have two principal functions. First, they enable the container 30 to be held against a rounded support wall such as wall 24 of golf bag 20. Secondly, they limit vertical movement of the container when attached against a support wall having an upper beaded edge such as the upper beaded edge 22 of wall 24 of golf bag 20.

According to the preferred embodiment shown in the drawings, brush means 60 are attached to the front wall of container 30. The brush means are preferably formed of stiff nylon bristles 62 held within a molded, thickened brush backing portion 64. The bottom edge 63 of backing portion 64 provides a retaining lip which limits the downward movement of the container. The lower front wall portion 33 of the container slants inwardly toward the container back 34 at an angle, preferably about 15°, sufficient to permit easy insertion of the container within the retaining means.

Figure 6:
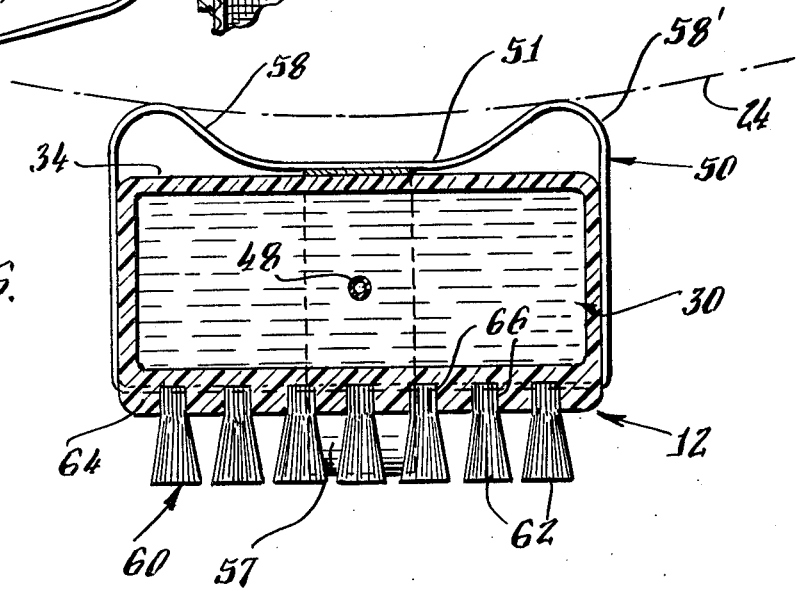
FIG. 6 is a transverse cross-section taken along line 6—6 in FIG. 5.

The backing portion 64 is shown in FIGS. 5 and 6 to have molded recesses 66, which can be formed during the molding operation by appropriately configuring the mold, to hold the bristles 62. It is preferred to integrally form the brush means 60 with the container 30 in this or other like manner to enable both an application of liquid cleaner and brushing by hand, without needing to move the object to be cleaned to the cleaning device held on the support or to remove the entire cleaning device including the retaining means 50 from the support. The container 30 also preferably has a convenient hand grip shown as grooved projections 38 and 38' on opposite sides of the container 30, enabling positive gripping action of the container 30 for removal from the retaining means and for holding for hand scrubbing even when wet with cleaning liquid.

The spray dispenser 40 is of conventional construction, having a cap 42 for threadably engaging an upper threaded neck portion 39 of the container. Plunger 44 extends into pump cylinder 46 for forcing liquid material drawn from container 30 through line 48 out of spray nozzle opening 49 at the top of the plunger 44. Leakproof pumps are preferred. Preferably, the nozzle is arranged to direct the spray perpendicular to the longitudinal axis of the container 30. If desired, it is possible to employ other spray dispensers as are known in the art in place of the particular arrangement shown in the drawings. And, it is also possible according to the present invention to provide one or more liquid nozzles within the brush backing portion 64 of the brush means 60 to permit direct application of liquid at the surface being scrubbed by the brush means 60.

The retaining means, shown generally as 50 in the drawings, with particular reference to FIG. 3, preferably comprises a sleeve 52 defining an opening to receive the dispenser means 12, and a clip means 54 for attaching the sleeve 52 to a support such as wall 24 of golf bag 20 having an upper beaded edge 22. The clip 54 is preferably configured to neatly conform to the conventional beaded upper edge of a golf bag wall. To protect the golf bag wall 24 from scratching by the clip 54, a plastic protective coating 59, seen best in FIG. 6, is preferably applied to the clip 54.

A support release 56, of generally U-shaped construction, is shown to be attached to the front, and rear walls of the sleeve 52. According to the preferred construction as shown in the drawings, the lower front portion 57 of the support release 56 projects outwardly such that, when pressed inwardly (and somewhat downwardly) toward the golf bag or other support wall, the outwardly projecting lobes 32 and 32' on the rear surface of the container 30 are pivoted out of engagement with the beaded upper edge 22 of the golf bag wall 24 to permit removal of the container 30 from the retaining means 50. This outwardly projecting portion 57 at the lower end of support release 56 also provides a convenient towel holder. The entire retaining means 50 can be constructed of a resilient material, such as spring steel. Preferably the sleeve comprises 0.5 inch wide steel having a thickness of about 0.025 inches and having a corrosion resistant surface. Also preferably, the support release 56 and the clip 54 are constructed of a unitary strip of 0.75 inch wide spring stainless steel having a thickness of about 0.018 inches. The unitary strip comprising support release 56 and clip means 54 are welded or otherwise secured to the sleeve 52 at both front and rear positions. The rear wall of the sleeve 52 is configured to provide outwardly projecting portions 58 and 58' proximate the side walls of the sleeve 52 and also to provide an inwardly projecting central portion 51 which is preferably constructed to press against the rear wall 34 of the container 30.

Tests of a device according to the present invention have shown that it is practical and convenient to use during a round of golf. In fact, it has been my experience, that it makes proper cleaning of club faces a matter of habit and to some extent relieves the tension often accompanying long waits between shots during times when the golf course is crowded. And, because it enables cleaning in a matter of seconds, it never adds to the tension of the game by causing delays. Dirty clubs are rapidly cleaned. The routine cleaning of club faces fostered by the present invention assures the performance of the clubs to their design capability for providing better bite, more action and improved accuracy.

The above description is for the purpose of teaching those skilled in the art how to make and use the present invention. It is not intended to describe in detail all those obvious modifications and variations of the invention which will become apparent to the skilled designer upon reading this description. It is intended, however, to include all such modifications and variations within the scope of the invention which is defined by the following claims.

I claim:

1. A golf club cleaning device capable of releasably engaging the wall of a golf bag, comprising: a liquid dispensing means comprising a liquid container and liquid spray means, the container having a front wall facing away from the wall of the golf bag and a rear wall including outwardly projecting portions facing the wall of the golf bag; retaining means for holding the dispensing means and attaching it to the wall of a golf bag, the retaining means comprising a sleeve defining an opening to receive the dispensing means, the sleeve having a rear-wall including outwardly projecting portions facing the wall of the golf bag; generally U-shaped clip means adapted to slip over the edge of a wall of a golf bag, and a generally U-shaped support release extending downwardly from points of attachment to front and rear walls of the sleeve; and brush means associated with the liquid dispensing and retaining means, the brush means having bristles facing outwardly; the projections on both the rear wall of the container and the rear wall of the sleeve being adapted to releasably engage a golf bag wall having a beaded upper edge, the projections preventing movement of the device past the beaded upper edge of the golf bag under normal conditions, but configured such that when the support release is pressed inwardly toward the golf bag wall, the device is pivoted about the outwardly projecting portions on the rear wall of the sleeve to move the outwardly projecting portions on the rear wall of the container from engagement with the golf bag wall to permit removal of the container from the retaining means.

2. A golf club cleaning device according to claim 1 wherein the lower front portion of the support release projects outwardly.

3. A golf club cleaning device according to claim 1 wherein the brush means is integral with the front wall of the liquid container.

4. A golf club cleaning device according to claim 1 wherein the retaining means comprises steel.

* * * * *